US012385328B2

(12) United States Patent
Reckmann

(10) Patent No.: US 12,385,328 B2
(45) Date of Patent: Aug. 12, 2025

(54) FLEXIBLE COUPLER FOR REDUCING TORSIONAL OSCILLATIONS

(71) Applicant: Baker Hughes Oilfield Operations LLC, Houston, TX (US)

(72) Inventor: Hanno Reckmann, Nienhagen (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 25 days.

(21) Appl. No.: 18/331,636

(22) Filed: Jun. 8, 2023

(65) Prior Publication Data

US 2023/0407712 A1 Dec. 21, 2023

Related U.S. Application Data

(60) Provisional application No. 63/351,002, filed on Jun. 10, 2022.

(51) Int. Cl.
*E21B 17/07* (2006.01)

(52) U.S. Cl.
CPC ..... *E21B 17/07* (2013.01); *E21B 17/073* (2013.01); *E21B 17/076* (2013.01)

(58) Field of Classification Search
CPC ..... E21B 17/07; E21B 17/073; E21B 17/076
See application file for complete search history.

(56) References Cited

U.S. PATENT DOCUMENTS 3,254,508 A * 6/1966 Garrett ..... E21B 17/07 175/321
3,263,446 A * 8/1966 Wiggins, Jr. ..... E21B 17/073 175/320
4,428,443 A * 1/1984 Oliphant ..... E21B 17/07 175/321
6,098,726 A 8/2000 Taylor et al.
(Continued)

FOREIGN PATENT DOCUMENTS

CN 103939092 A 7/2014

OTHER PUBLICATIONS

Castro and Moe "Overcoming Drilling Performance Limiters for Extended Horizontal Wells in the Permian Basin" American Association of Drilling Engineers, 2019.
(Continued)

*Primary Examiner* — Giovanna Wright
(74) *Attorney, Agent, or Firm* — CANTOR COLBURN LLP

(57) ABSTRACT

An embodiment of a coupling device includes an elongated coupler body configured to be deployed at a borehole string and connected to a downhole component of a borehole string. The coupler body has a longitudinal axis, and the coupler body has a torsional stiffness sufficient to transmit rotational motion to the connected downhole component. The coupling device also includes at least one recess formed in a wall of the coupler body, the at least one recess extending along a periphery of the coupler body in a direction generally perpendicular to the longitudinal axis.
(Continued)

The at least one recess is configured to impart a bending stiffness that is less than or equal to a reference bending stiffness, and the torsional stiffness and the bending stiffness are selected to modify a mode shape of an undesired torsional oscillation.

20 Claims, 7 Drawing Sheets

(56) References Cited

U.S. PATENT DOCUMENTS

| | | | | |
|---|---|---|---|---|
| 9,976,405 | B2 | 5/2018 | Hohl et al. | |
| 2014/0305660 | A1 | 10/2014 | Ash et al. | |
| 2018/0252089 | A1 | 9/2018 | Hohl et al. | |
| 2019/0284882 | A1* | 9/2019 | Peters | E21B 17/073 |
| 2021/0079736 | A1 | 3/2021 | Reckmann et al. | |
| 2021/0079738 | A1 | 3/2021 | Peters | |
| 2021/0079976 | A1 | 3/2021 | Peters | |

OTHER PUBLICATIONS

International Search Report for International Application No. PCT/US2023/024829, International Filing Date Jun. 8, 2023, Date of Mailing Sep. 21, 2023, 4 pages.

Written Opinion for International Application No. PCT/US2023/024829, International Filing Date Jun. 8, 2023, Date of Mailing Sep. 21, 2023, 5 pages.

* cited by examiner

FLEXIBLE COUPLER FOR REDUCING TORSIONAL OSCILLATIONS

CROSS REFERENCE TO RELATED APPLICATIONS

This application claims the benefit of U.S. Provisional Patent Application Ser. No. 63/351,002 filed Jun. 10, 2022, the disclosure of which is incorporated herein by reference in its entirety.

BACKGROUND

In the resource recovery and fluid sequestration industry, various types of drill strings are deployed in a borehole for purposes such as exploration and production of hydrocarbons. A drill string generally includes drill pipe or other tubular and a bottomhole assembly (BHA). While deployed in the borehole, the drill string may be subject to a variety of forces or loads. For example, the BHA or other components can experience torsional vibrations having various frequencies and simultaneously rotating bending loads. Such vibrations, including high-frequency vibrations and loads, can cause irregular downhole rotation, reduce component life and compromise measurement accuracy.

SUMMARY

An embodiment of a coupling device includes an elongated coupler body configured to be deployed at a borehole string and connected to a downhole component of a borehole string. The coupler body has a longitudinal axis, and the coupler body has a torsional stiffness sufficient to transmit rotational motion to the connected downhole component. The coupling device also includes at least one recess formed in a wall of the coupler body, the at least one recess extending along a periphery of the coupler body in a direction generally perpendicular to the longitudinal axis. The at least one recess is configured to impart a bending stiffness that is less than or equal to a reference bending stiffness, and the torsional stiffness and the bending stiffness are selected to modify a mode shape of an undesired torsional oscillation.

An embodiment of a method of performing a subterranean operation includes deploying a borehole string in a borehole, performing the subterranean operation, the performing including rotating a downhole component, and modifying undesired oscillations occurring due to the rotating by a coupling device connected to the downhole component. The coupling device includes an elongated coupler body having a longitudinal axis and a torsional stiffness sufficient to transmit rotational motion to the downhole component, and at least one recess formed in a wall of the coupler body. The at least one recess extends along a periphery of the coupler body in a direction generally perpendicular to the longitudinal axis, and the at least one recess imparts a bending stiffness that is less than or equal to a reference bending stiffness, the torsional stiffness and the bending stiffness selected to modify a mode shape of an undesired torsional oscillation.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
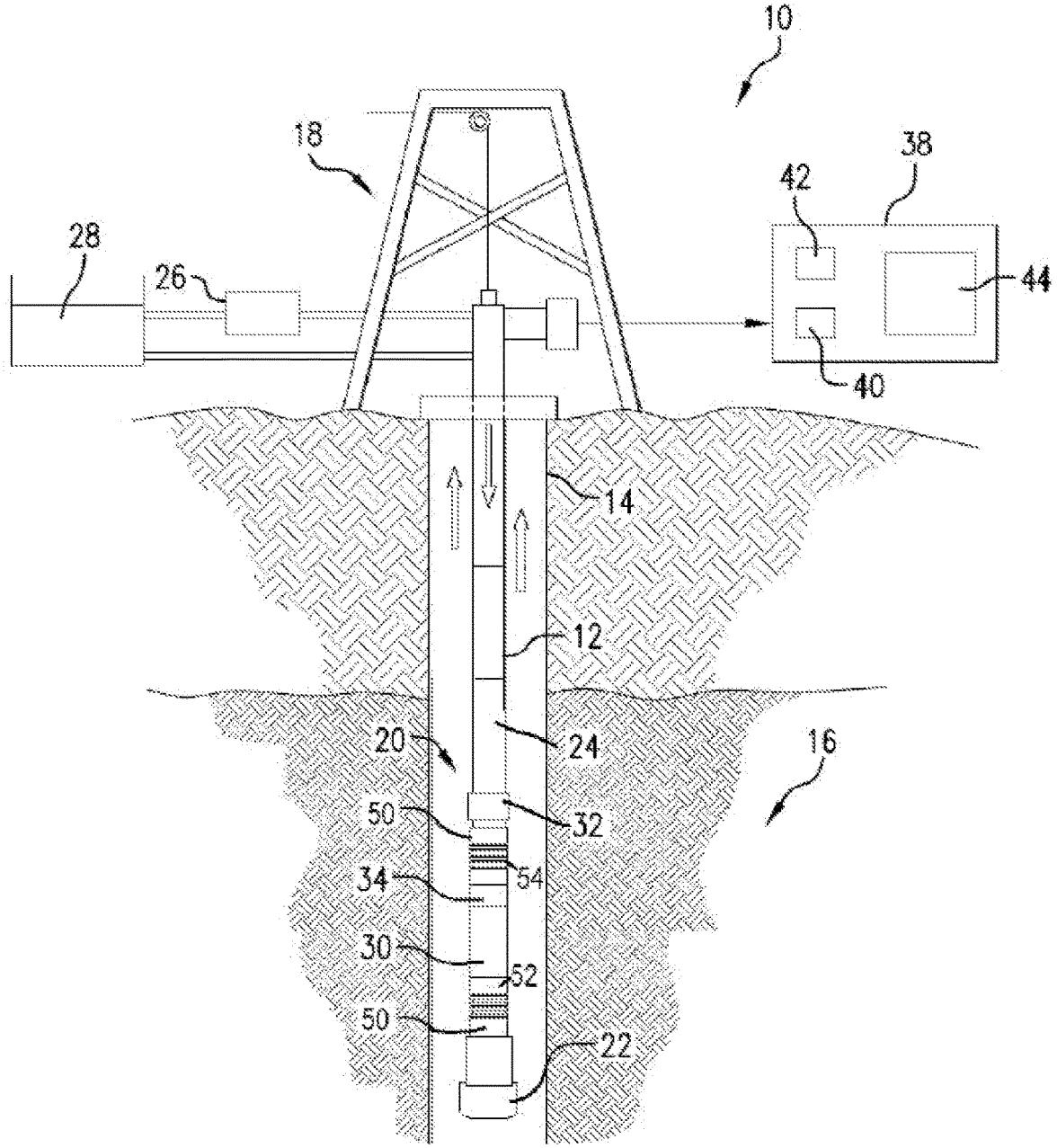
FIG. 1 depicts an embodiment of a drilling and/or formation measurement system including a flexible coupler for facilitating or aiding the damping of undesired oscillations.

A detailed description of one or more embodiments of the disclosed apparatus and method are presented herein by way of exemplification and not limitation with reference to the Figures.

Apparatuses and methods for performing subterranean operations and damping undesired vibrations or oscillations are described herein. Embodiments include a torsionally stiff and laterally flexible coupling device (also referred to as a "coupler") that is configured to be disposed with a borehole string, such as a drill string and/or logging-while-drilling (LWD) string. The coupler is configured to aid in damping or reducing undesired torsional vibrations or oscillations, such as stick/slip oscillations and high frequency torsional oscillations. The coupler aids or facilitates the effectiveness of a damping device by modifying or tuning mode shapes of undesirable torsional oscillations so that the damping device can more effectively damp such oscillations.

The coupler is "torsionally stiff" in that the coupler is capable of effectively transmitting rotational motion in the drill string. The coupler, by virtue of at least the torsional stiffness, is configured to favorably tune vibrational mode shapes (e.g., by shifting location of maxima and minima, changing amplitude, changing frequency and/or modifying other parameters of a vibrational mode). The coupler can thus improve the utilization of damping devices.

The coupler body or structure may include one or more bending features that allow the coupler to maintain torsional stiffness while being laterally flexible. "Lateral flexibility" or "bending flexibility" refers to a property of the coupler that allows the coupler to bend in a lateral direction that is generally perpendicular to a longitudinal axis of the coupler, borehole string and/or borehole. The bending features, in an embodiment, impart bending flexibility such that the bending stiffness is below a selected stiffness threshold and/or a ratio of bending stiffness to torsional stiffness is below a threshold ratio value.

An embodiment of the coupler includes one or more recesses in the coupler body that impart a desired bending stiffness. The recesses extend along a periphery or circumference of an outer surface of the coupler body in a direction that is perpendicular or generally perpendicular to a longitudinal axis of the coupler body. "Perpendicular" refers to an angle of 90 degrees between the longitudinal axis of the coupler body and the direction of the extension of the recess along the circumference of the coupler. "Generally perpendicular" refers to the direction of the extension of the recess along the circumference of the coupler forming an angle to the longitudinal axis of greater than or equal to 80 degrees, or greater than or equal to 85 degrees. In an embodiment, the direction of the extension of the recess along the circumference of the coupler may form an angle with the longitudinal axis that slightly deviates from 90 degrees, such as a deviation within 0.1 to 4.9 degrees, a deviation within 0.1 to 10 degrees, or a deviation within 0.1 to 15 degrees. The recesses may be at least partially filled with a flexible material, such as rubber or an elastomer. In an embodiment, the coupler includes one or more slots that extend circumferentially along a periphery of the coupler body in the generally perpendicular direction. The slots or recesses may include various stress relief features that allow the coupler to bend without damaging or overly stressing the coupler body.

Embodiments described herein provide a number of advantages and technical effects. The coupling devices and systems described herein provide an effective mechanism to support damping devices and elements in compensating for unwanted oscillations by providing coupling devices that have torsional stiffness and bending flexibility. Such coupling devices are able to effectively transmit rotational motion while aiding in damping undesirable modes (e.g., stick/slip and high frequency oscillations). In addition, the coupling devices described herein require fewer components and have fewer moving parts as compared to other damping devices.

The coupling devices described herein are advantageous over conventional torsional flex couplings (flex subs), which are typically made of a single piece of material but are flexible due to a smaller outer diameter in the flex area. This smaller diameter, which increases flexibility, also decreases the torsional stiffness significantly and in this way, decouples the damping device in a BHA from torsional oscillations. Decoupling torsional oscillations from the damping device makes the damping device become ineffective or work inefficiently. The coupling devices described herein provide flexibility while retaining torsional stiffness. The torsional stiffness allows transfer of torsional oscillations through a coupler to a damping device so that damping of the torsional oscillation at the damping device is performed effectively. The coupling device at the same time is bending flexible, supporting high build rates (angle from vertical direction per drilled distance) of the BHA and thus good directional drilling properties of the BHA.

FIG. 1 shows an embodiment of a system 10 for performing a subterranean operation (e.g., drilling, measurement, stimulation and/or production). The system 10 includes a borehole string 12 that is shown disposed in a well or borehole 14 that penetrates a subterranean region 16 (including, for example, at least one earth formation).

The borehole string 12 is operably connected to a surface structure or surface equipment 18 such as a drill rig, which includes or is connected to various surface components. In an embodiment, the borehole string 12 is a drill string including one or more drill pipe sections that extend downward into the borehole 14, and is connected to various downhole components, all or some of which may be incorporated in a bottomhole assembly (BHA) 20.

The BHA 20 includes a drill bit 22, which may be driven from the surface (e.g., via a surface drive or rotary table, or driven by a downhole mud motor 24. The surface equipment 18 includes components to facilitate circulating fluid such as drilling mud through an inner bore of the borehole string 12 and an annulus between the borehole string 12 and the borehole wall. For example, a pumping device 26 is located at the surface to circulate the fluid from a mud pit or other fluid source 28 into the borehole 14 as the drill bit 22 is rotated. The borehole string 12 is discussed as a drill string 12, but is not so limited and can be any type of borehole string (e.g., string for hydraulic fracturing and/or other stimulation, wireline string, wellbore intervention string, fishing string, milling string, etc.)

The system 10 may include one or more of various downhole components configured to perform selected functions downhole such as controlling drilling, controlling drilling direction, performing downhole measurements, facilitating communications, performing stimulation operations and/or performing production operations. For example, the downhole components include a logging while drilling (LWD) or measurement while drilling (MWD) tool 30, the mud motor, a rotary steerable component (e.g., a rib-based or other steering head) and a stabilizer 32 or vibration damping devices.

Other components may include a telemetry assembly such as a mud pulse telemetry (MPT) assembly, for communicating with the surface and/or other downhole tools or devices. The telemetry assembly includes, for example, a pulser that generates pressure signals through the fluid.

The system 10, in an embodiment, includes a damping device 34 configured to provide torsional vibration damping and mitigate vibrations such as stick/slip and HTFO vibrations. The number, type and location of damping devices 34 is not limited to that shown in FIG. 1. Examples of damping devices include friction dampers, which include two or more bodies or damper elements that interact to generate friction and dissipate energy, and hydraulic dampers, which incorporate a viscous fluid and an inertial mass. Other examples include magnetic dampers, which include a permanent magnet moveable relative to a conductive coil. Further examples include piezoelectric dampers, which include a piezoelectric material connected to the string and an inertial mass. Electrodes of the piezoelectric material are connected to a circuit that can be adjusted to damp torsional vibrations.

Examples of a hydraulic damping device are discussed in US Patent Publication No. 2021/0079976 A1, assigned to Baker Hughes Oilfield Operations LLC, and entitled "Viscous Vibration Damping of Torsional Oscillations", which is incorporated by reference herein in its entirety.

Additional examples of friction type dampers and hydraulic dampers, and methods of locating damping devices, are further discussed in US Patent Publication No. 2021/0079738 A1, assigned to Baker Hughes Oilfield Operations LLC, and entitled "Optimized Placement of Vibration Damper Tools Through Mode-Shape Tuning", which is incorporated by reference herein in its entirety.

One or more downhole components and/or one or more surface components may be in communication with and/or controlled by a processor such as a downhole processor and/or a surface processing unit 38. The surface processing unit 38 may control various parameters such as rotary speed, weight-on-bit, fluid flow parameters (e.g., pressure and flow rate) and others. The surface processing unit 38, in one embodiment, includes an input/output (I/O) device 40, a processor 42, and a data storage device 44 (e.g., memory, computer-readable media, etc.).

The system 10 includes at least one coupling or connection device configured to connect components of the drill string 12. The device, referred to herein as a coupler 50, is configured to support damping of torsional vibrations, such as high frequency torsional oscillations (HFTOs). The coupler 50 has a high torsional stiffness and low bending stiffness (high bending flexibility), which has been found to be effective in combination with a damping device configured to damp bit-induced and other high frequency torsional vibrations. The coupler 50 includes one or more bending features designed to provide flexibility in the lateral direction and allow the torsionally stiff coupler 50 to bend.

In an embodiment, the coupler 50 includes a coupler body 52 and one or more circumferentially extending recesses 54 that allow for a selected amount of bending. The selected amount of bending, along with the torsional stiffness of the coupler, acts to modify various undesired oscillation mode shapes in the BHA 20, including stick/slip modes and/or HFTO modes. For example, each coupler 50 includes one or more slots 54 that extend along the periphery (circumference) of the coupler body 52 in a direction that is perpendicular, generally perpendicular or only slightly deviated from the perpendicular direction to a longitudinal axis of the coupler body 52, allowing a degree of lateral bending. The slots 54 may extend around the entire periphery or the circumference of the coupler body as shown in FIG. 1 (i.e., have an angular extent of 360 degrees), or extend along an angular segment (such as 180 degrees).

Modification of torsional oscillation mode shapes is achieved by modifying the oscillation properties of the BHA 20 (or other borehole string or portion thereof) by placing a torsionally stiff and bending flexible downhole component (e.g., the coupler 50) at a predetermined location within the BHA 20. The coupler 50 is placed in the BHA 20 in a way that assures detrimental torsional oscillations are not excited or that the location of high amplitudes of detrimental torsional oscillation modes appear at a location in the BHA that includes a damping device. The damping device dampens the torsional oscillation and removes oscillational energy from the BHA 20. The damping device dissipates the rotational (oscillational) energy, such as by transforming rotational energy into heat. At the same time, the torsionally stiff coupler 50 is bending flexible to allow for directional drilling, including drilling with high borehole build rates (borehole inclination).

The coupler may be used in the BHA 20 in conjunction with a damping device, or without a damping device. In an embodiment, if a damping device is not present, the coupler 50 is used to ensure that detrimental (undesired) torsional oscillation modes appear at locations in the BHA 20 where no sensitive downhole components are located, such as sensitive formation evaluation measurement devices (e.g. nuclear tools, acoustic tools, NMR tools, MWD tools, etc.).

HTFO modes can arise due to various factors, such as cutting forces at a drill bit or other cutting structure. Certain vibratory mode shapes can be induced by various cutting forces at the drill bit 22 (e.g., harmonic excitation forces and impacts), and by self-excitation of vibration due to falling aggressiveness of the drill bit 22 relative to angular velocity.

A downhole system and borehole string, such as the drill string 12 of FIG. 1, includes various components that have different physical characteristics (e.g., diameter, mass, density, configuration, etc.). During rotation, different components may cause various torsional oscillation modes to be generated, which can have varying amplitudes, frequencies, mode shapes and other parameters.

Severe vibrations in drill strings and bottom hole assemblies during drilling operations can be caused by cutting forces and/or mass imbalances in downhole tools such as drilling motors. Such vibrations can result in reduced rate of penetration, reduced quality of the borehole, reduced quality of measurements made by tools of the bottom hole assembly, and can result in wear, fatigue, and/or failure of downhole components. Different vibrations exist, such as lateral vibrations, axial vibrations, and torsional vibrations. For example, stick/slip of the whole drilling system and HFTOs are both types of torsional vibrations. The terms "vibration" and "oscillation" are used with the same broad meaning of repeated and/or periodic movements or periodic deviations of a mean value, such as a mean position, a mean velocity, and a mean acceleration. These terms are not meant to be limited to harmonic deviations, but may include all kinds of deviations, such as, but not limited to periodic, harmonic, and statistical deviations.

Torsional vibrations may be excited by self-excitation mechanisms that occur due to the interaction of the drill bit 22 or any other cutting structure (e.g., a reamer bit) and the formation. The main differentiator between stick/slip and HFTO is the frequency and typical mode shapes: For example, HFTO have a frequency that is typically above 50 Hz compared to stick/slip torsional vibrations that typically have frequencies below 1 Hz. HFTO modes that can be modified using the coupler 50 may lie in a range between of 50 Hz and 500 Hz, but are not so limited. The excited mode shape of stick/slip is typically a first mode shape of the whole drilling system, whereas the mode shape of HFTOs can be of higher order and are commonly localized to smaller portions of the drill string 12.

Figure 2:
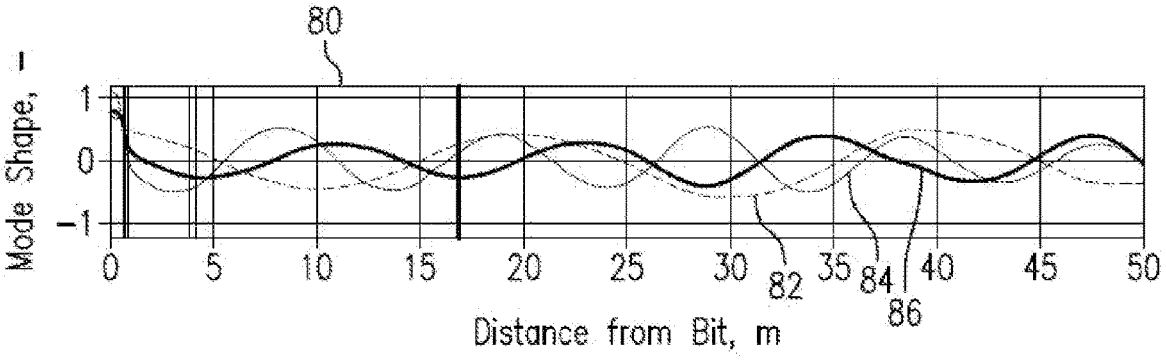
FIG. 2 depicts examples of mode shapes related to vibrations and oscillations of a borehole string.

FIG. 2 is a graph 80 that illustrates examples of mode shapes that can be induced during rotation. The mode shapes are represented as curves of amplitude (normalized from −1 to 1) as a function of distance from a cutting structure (e.g., the drill bit 22). This distance is in meters, and zero represents a location of the cutting structure. The examples include a mode shape 82 of a first torsional oscillation, a mode shape 84 of a second torsional oscillation, and a mode shape 86 of a third torsional oscillation of a borehole string. Based on the knowledge of the mode shapes 82, 84 and 86, the position of damping devices and/or damping elements can be optimized.

Mode shapes are modified due to the bending flexibility (which affects lateral mode shapes) and torsional stiffness (which affects torsional mode shapes) of the coupler 50. For example, the torsional stiffness can be selected (e.g., by selecting specific slot dimensions in the coupler) to change or affect the frequency of a mode shape that arises in a drill string, the distance between a maximum and minimum of a mode shape, the location of a maximum and/or minimum along the string, the amplitude of the maximum and minimum, and others. By controlling the distance to the bit and/or location in the BHA, the coupler 50 can tune or modify mode shapes so that maxima and minima occur at locations conducive to inclusion of damping devices or damping elements. Furthermore, the location of maxima and minima can be shifted to minimize vibrations at selected positions along the string (e.g., positions with less sensitive downhole components). In addition, the maxima and minima locations can be controlled to increase or maximize amplitude at locations of damping elements.

Exemplary mode shapes are further discussed in US Patent Publication No. 2021/0079738 A1, which is referred to above. Additional examples of mode shapes are discussed in US Patent Publication No. 2018/0252089 A1, assigned to Baker Hughes, a GE Company LLC, and entitled "Method to Mitigate Bit Induced Vibrations by Intentionally Modifying Mode Shapes of Drill Strings by Mass or Stiffness Changes", which is incorporated by reference herein in its entirety. Optimal placement of the coupler may be achieved by simulating torsional oscillations in the borehole string using a mathematical algorithm, such as an algorithm described in US Patent Publication No. 2018/0252089 A1. The simulation provides mode shapes for different torsional oscillation modes along a borehole string, as displayed in FIG. 2. The simulation provides information on which mode shapes occur in a borehole string and the location of the occurring mode shape amplitudes. The simulation indicates a location or locations where high torsional oscillation amplitudes occur. Based on the simulation, the placement of the coupler 50 in the borehole string can be determined in order to modify torsional oscillations modes to act less detrimental on the downhole components of the borehole string. The placement of the coupler influences the frequency of torsional oscillation that occur along the borehole string, influences the location of the highest amplitudes (maximum) of torsional mode shapes and influences the magnitude of the amplitude of a mode shape.

Figure 3A:
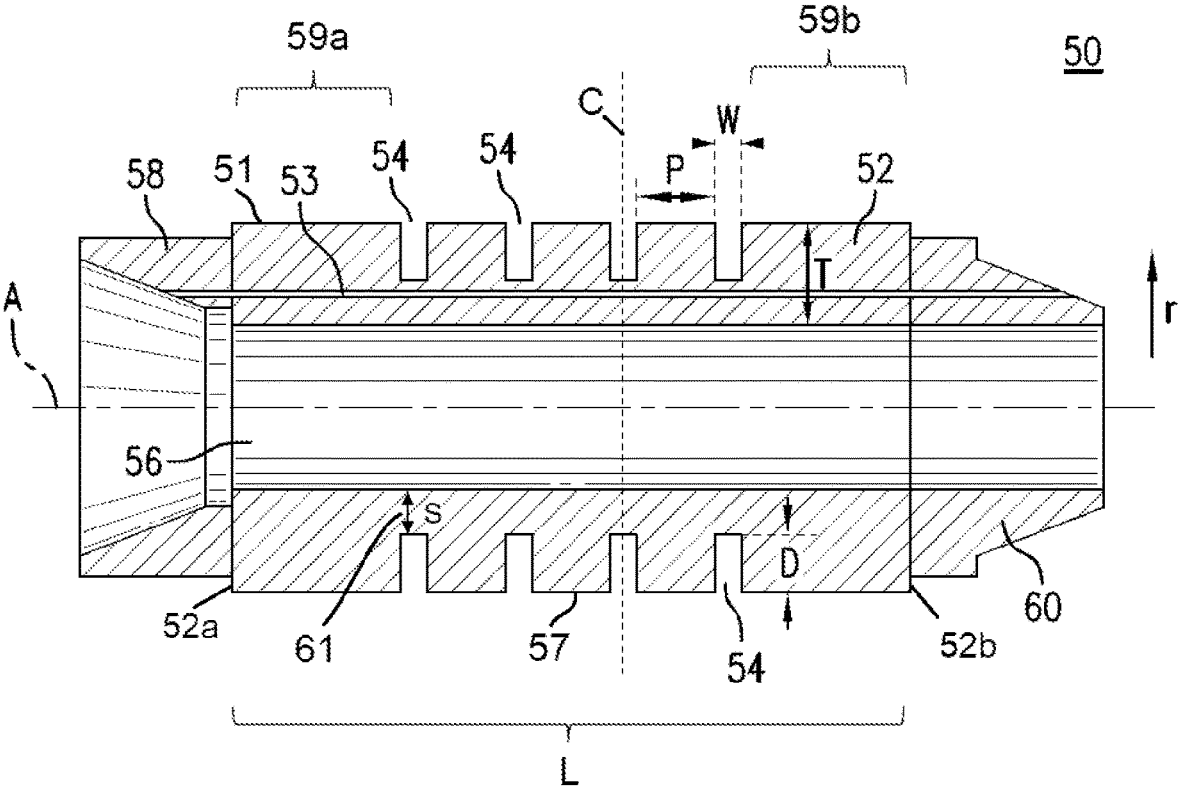
FIGS. 3A and 3B depict an embodiment of a coupler for facilitating or aiding the damping of undesired oscillations, including at least one slot configured to impart bending flexibility to the coupler body.
Figure 3B:
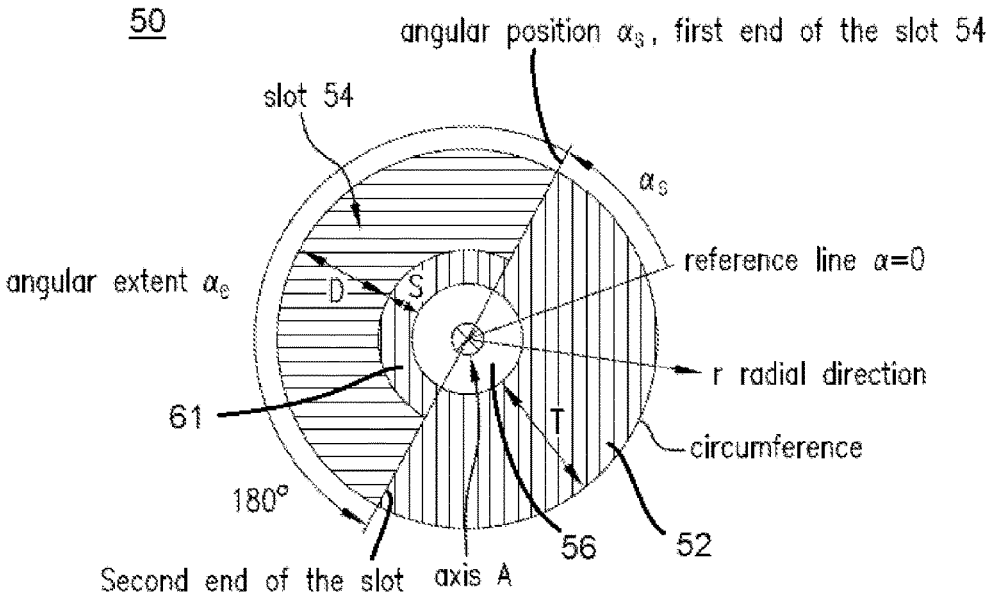

FIGS. 3A and 3B depict an embodiment of the coupler 50, in which the coupler body 52 includes a plurality of generally perpendicular slots arrayed 54 along a length L of the coupler body 52 formed in a wall of the coupler body 52. As shown in FIG. 3A, the wall has an outer surface 51. The coupler body 52 has a longitudinal axis A that defines an inner fluid bore or fluid conduit 56 that can be put in fluid communication with other downhole components when the coupler 50 is connected thereto and that allows downhole fluid circulation through the borehole string while drilling the borehole. The rotational symmetry axis of the fluid conduit 56 may coincide with the rotational symmetry axis of the coupler 50. The coupler body 50 and slots 54 can be manufactured by machining (e.g., milling and turning), casting, additive manufacturing (e.g., 3D printing) and/or other suitable process.

In an ideal case, the coupler body 52 has a torsional stiffness that corresponds to a solid tubular (drill collar) with corresponding material properties, length, outer diameter and inner diameter (diameter of inner bore) and a bending flexibility that is sufficient to allow bending according to a borehole (inclination) build rate of, for example, 15 degrees per 100 feet of borehole length. As a torsional stiff downhole component is usually also bending stiff, or a bending flexible downhole component is usually also torsional flexible, the coupler 50 includes various structural modifications as compared to a solid tubular, to get as close to the desired coupler body properties as possible. Examples of such modifications are shown in FIG. 3A. The torsional stiffness of a corresponding solid tubular (i.e., a drill collar or other component having no slots) is also referred to herein as a "reference torsional stiffness." A desired bending flexibility (e.g., capable of supporting bending according to 15 degrees per 100 feet borehole length) is referred to herein as to a "reference bending flexibility," wherein the bending is including bending under rotation of a borehole string (rotational bending). A torsional stiffness threshold may be defined as 90%, 80%, or 70% of the torsional stiffness of a corresponding tubular. The torsional stiffness of the coupler 50 or coupler body 52 is assumed to be greater or equal the torsional stiffness threshold.

The coupler body 52 may be configured to relay power and/or communications transmitted through a borehole string. For example, the coupler includes an internal bore, channel, or conduit 53 for an electrical connection (e.g., wire or cable) or other connection (e.g., fiber optic).

The coupler 50 includes any suitable connection mechanism or component that allows the coupler 50 to be connected to other string components. For example, the coupler includes a box connector 58 having internal threading, and a pin connector 60 having external threading.

The slots 54 may extend around the entire periphery or circumference of the coupler body 52, but are not so limited. For example, a slot 54 may have any desired angular position and/or angular extent. An "angular position" may be defined in a plane that is orthogonal or generally orthogonal (e.g., within 5 degrees) to the axis A (such as a plane position indicated by line C) and extends in the radial direction r A cross-section of the coupler 50 in the plane indicated by line C is illustrated in FIG. 3B. The angular position is defined by an angle $\alpha_s$ formed between a reference line in the plane (e.g., a zero degree line, i.e., $\alpha$=0) and a line between the axis A and a position of the slot 54 (such as a first end of the slot 54). An "angular extent" $\alpha_e$ refers to a difference between an angular position along the circumference of the coupler body 52 of one end of the slot (such as the first end of the slot 54) and an angular position along the circumference of the coupler body 52 of an opposite end of the slot (second end of the slot 54). The angular extent $\alpha_e$ is also referred to herein as an extension of the slot 54 along the circumference of the outer surface 51 of the coupler body 52. The slots 54 may define a plurality of parallel planes orthogonal or generally orthogonal to the axis A.

In an embodiment, the slots 54 may define a plurality of planes, where each of the plurality of planes is generally orthogonal to the axis A. In this embodiment, the planes are not exactly parallel to each other, but may form a small angle relative to each other, such as an angle between 0.1 degrees and 5 degrees, or between 0.1 degrees and 10 degrees.

In an embodiment, the plurality of slots 54 defines a density of slots. The density of slots is defined by a number of slots along a certain length of the coupler; for example, the density of slots may be 5 slots per meter (m) length of the coupler body, or 10 slots per meter length of the coupler body. The plurality of slots have a width W. The sum of the width W (total width) of each of the plurality of slots allows for defining a density of width. The density of width is defined by the total width along a certain length of the coupler body 52 (e.g., the density of width may be up to 0.5 meters, up to 0.4 meters, or up to 0.3 meters per meter length of the coupler body 52. It is noted the plurality of slots 54 may not all have the same width W, as the with may vary from one slot 54 to a neighboring slot 54. In other examples, groups of slots 54 in the plurality of slots 54 may have a first width $W_1$ and another group in the plurality of slots may have a second width $W_2$.

Each slot 54 has a depth D measured along a radial direction r, a width W measured along an axial direction (i.e., the direction of the axis A) and an angular extent $\alpha_e$ along the circumference of the coupler body 52, which may have any suitable value. The depth D may be defined relative to a thickness T of the coupler body wall in the radial direction r, for example, as a percentage or proportion of the thickness T, or as a ratio of depth D to thickness T (D/T). For example, D/T could range from 1/10 to 9/10, and would be influenced by the torque capacity and the desired axial load capacity of the coupler 50. The depth D and width W are selected to impart a desired amount of flexibility based on expected modes and/or mode shapes. For example, the desired amount of flexibility may be a selected bending stiffness that is less than a selected threshold. The depth D defines a central support portion 61 of the coupler 50. The central support portion 61 defines a central support wall around the fluid conduit. The central support wall having a thickness S in radial direction r. The depth D of the slot and the thickness S of the central support wall defines the thickness T of the coupler wall. The depth D may be defined relative to the thickness S of the central support wall (D/S).

A width W may be selected based on a ratio W/P of the width W to a distance P (defined by leftover material or defined by a partition wall 57 between adjacent or neighboring slots 54). For example, the ratio may range from 1/10 to 9/10, or may be larger than one, in such a way that maximum torsional stiffness is maintained. Distances P can be regular or constant, but are not so limited. Generally, a greater D or higher D/T and greater W or higher W/P coincide with smaller bending stiffness, and a smaller P coincides with smaller bending stiffness. Alternatively, the width W may be selected based on a ratio of the width W to the length L of the coupler body 52 may be selected (W/L).

It is noted that there may be any number of slots 54 having any desired angular position $\alpha_s$ and angular extent $\alpha_e$. In an embodiment, the coupler 50 includes a plurality of slots 54, which have the same angular extent and angular position. In other embodiments, a slot 54 has a different angular extent and/or angular position relative to one or more other slots 54 at the same axial position (i.e., same location along the axis A) or at different axial positions. The coupler body 52 may be formed from an integral block of material (e.g., steel, stainless steel, Inconel, Titanium, etc.). That is, the slots 54, the internal bore 56, and the fluid conduit are manufactured in the coupler body 52 without using any mechanical connections, such as threads, clamps, welds, etc.

As shown in FIG. 3A, the coupler body 52 includes a first solid annular portion 59*a* and a second solid annular portion 59*b* determining a first terminal end 52*a* and a second terminal end 52*b* of the coupler 50. The first solid annular 59*a* portion includes or is mechanically connected to a first threaded coupling portion 58 (e.g., a box connector) and the second solid annular portion 59*b* includes or is mechanically connected to a second threaded coupling portion 60 (e.g., a pin connector). The first and second threaded coupling portions both include a fluid conduit coinciding or at least overlapping with the fluid conduit 56 in the coupler body 52. The first and second threaded coupling portions 56 and may be connected to the respective first and second solid annular portions 59*a* and 59*b* of the coupler body 52 by welding or any other suitable mechanical connection means (e.g. threads, clamps, glued connection).

In an embodiment, the coupler body 52 and the first and second threaded coupling portions 56 and 60 are manufactured from one integral piece of material. The coupler body 52 promotes bending by the slotted configuration. Bending in this context refers to a longitudinal axis of the first solid annular portion 59*a* tilting relative to a longitudinal axis of the second solid annular portion when a bending moment is applied over the length L of the coupler body 52.

The coupler body 52 may have any suitable length L, slot width W, wall thickness T, partition wall thickness P, central support wall thickness S, slot depth D and/or other dimensions. In an embodiment, the length L of the coupler body 52 may be between 1 m and 2 m and the width W may be 20 mm, while a thickness T of the partition wall 57 may also be 20 mm. The coupler body 52 may have an outer diameter of around 6¾ inch (170 mm) and an inner diameter of around 1.5 inch (40 mm), leaving around 2.5 inch (65 mm) for the thickness T of the coupler body wall. The slot depth D may be at least 10% of the thickness T of the coupler body wall. In embodiments the slot depth may be at least 20%, 30%, 40%, 50%, or 60% of the thickness T of the coupler body wall. Correspondingly, the thickness S of the central support wall may be smaller than or equal to 90%, 80%, 70%, 60%, or 40% of the thickness T of the coupler body wall. The coupler body 52 including the slots 54 (slotted area of the coupler body 52) may include 20 slots along a length of 0.8 m, leaving 0.2 m for the annular portions 59*a* and 59*b* at a coupler body length of 1 m. The coupler 50 may have any desired number of slots, for example, more than 20 slots (e.g., 30 slots or 40 slots). The coupler body 52 may be longer or the width of the slots may be smaller. In an embodiment, the slots may be larger than 20 mm, such as 30 mm, 35 mm, or 40 mm. The thickness P of the partition walls 57 may be greater than 20 mm, such as mm, 35 mm or 40 mm. The thickness P of the partition walls may be greater or smaller than the width of the slots 54. In an embodiment, the width W of the slots 54 and/or the thickness of the partition walls 57 may vary along the longitudinal axis A of the coupler body 52. In an embodiment, the width W of the slots 54 is large enough to ensure that, under bending, the opposing ends of the slots along the longitudinal axis of the coupler body 52 are not contacting.

The greater the slot width W, the higher the bending flexibility, but the lower the torsional stiffness. Therefore, in an embodiment, the number of slots 54, the width of the slots 54 and the thickness of the partition walls 57 are optimized. Optimization of the configuration of the coupler body 52 may be performed by a using simulation algorithms. The coupler body 52 may be longer than 2 m, such as 4 m or 5 m. However, the goal is to design a coupler body 52 that has sufficient torsional stiffness and sufficient bending flexibility while being as short as possible to ensure sensors in a BHA are located in a borehole string as close as possible to a drill bit.

Figure 4:
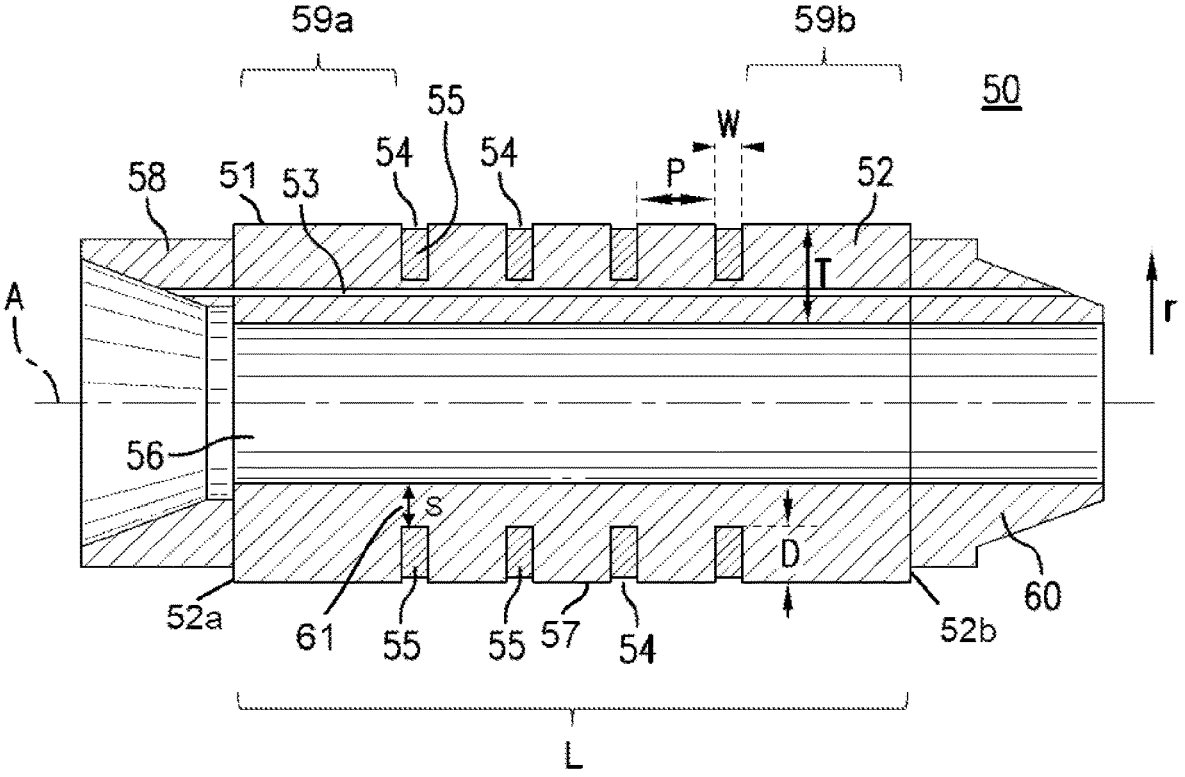
FIG. 4 depicts an embodiment of the coupler of FIG. 3, including a flexible material disposed in at least one slot.

In an embodiment, the coupler 50 includes a flexible material, such as a rubber material or an elastomer, which at least partially fills one or more slots 54. For example, as shown in FIG. 4, the coupler 50 includes a flexible material, such as an elastomer 55, that has a flexibility such that the flexible material does not significantly affect bending stiffness of the coupler 50. The elastomer can prevent plugging (e.g., with mud) and can add damping due its inner material damping properties. The added damping is related to damping of lateral vibrations as well as torsional vibrations. Due to the slots 54, relative rotation of the partition walls 57 between the slots 54 may occur in case of torsional oscillation. Due to the flexible material, the relative rotation leads to deformation of the flexible material and thus to energy dissipation, resulting in damping of the torsional oscillation.

Figure 5:
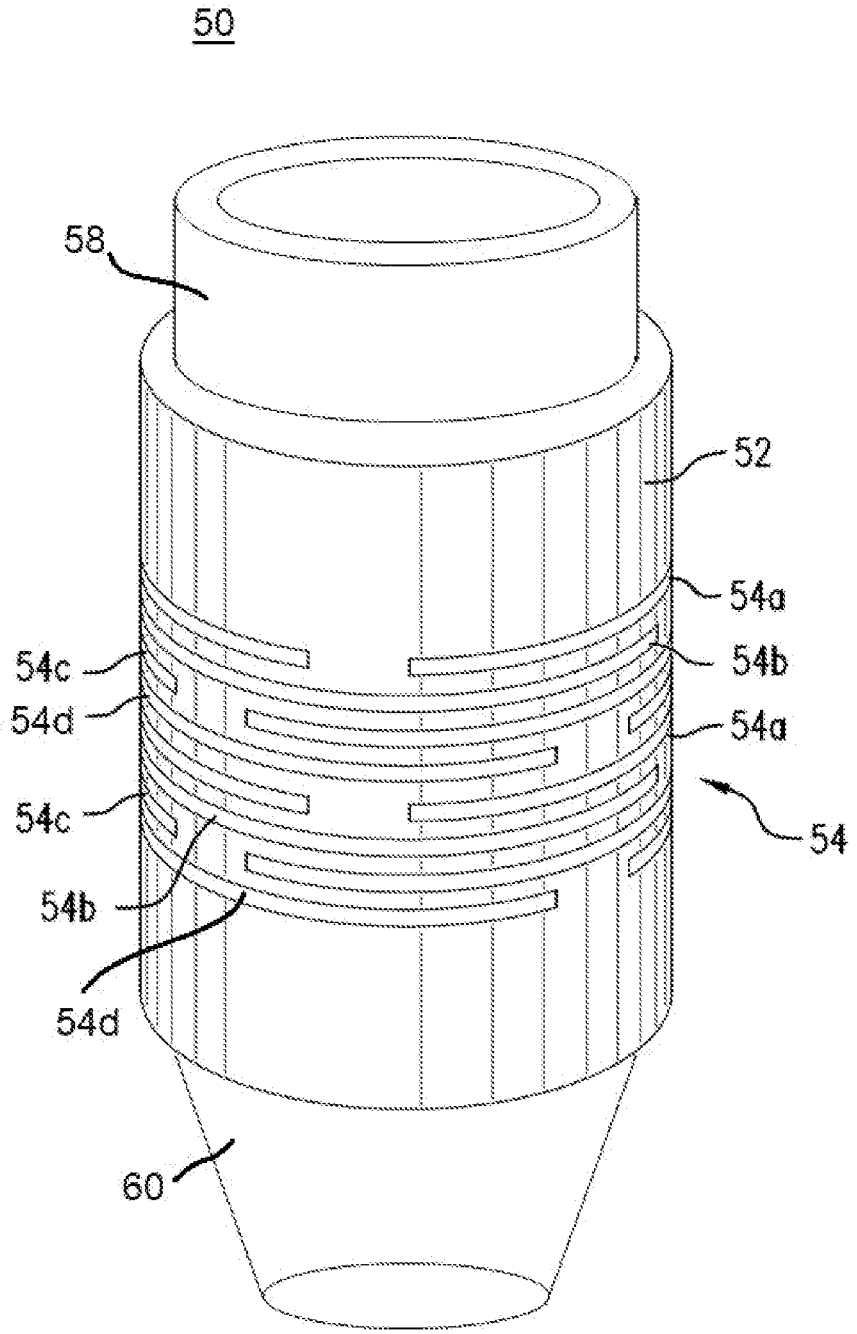
FIG. 5 depicts an embodiment of a coupler for facilitating or aiding the damping of undesired oscillations, including a plurality of slots, in which at least one slot is offset from at least one other slot.

FIG. 5 depicts an example of the coupler 50, which includes a plurality of slots 54 having angular extents that are less than 360 degrees. The slots 54 include a first set of slots 54*a*, a second set of slots 54*b*, a third set of slots 54*c*, and a fourth set of slots 54*d*. The length or angular extent of each set of slots is at least about equal and may be, for example, between 100 degrees to 170 degrees along the circumference of the coupler body 52. In this example, the second set of slots 54*b* is offset from the first set by about 90 degrees. The fourth set of slots 54*d* is offset from the third set of slots by about 90 degrees. The third set of slots 54*c* is offset from the first set of slots 54*a* and the second set of slots 54*b* by about 45 degrees. The fourth set of slots 54*d* is offset from the first set of slots by about 45 degrees and is offset from the second set of slots by about 135 degrees. In other words, the first end of the second set of slots 54*b* is offset by 90 degrees to the first end of the first set of slots 54*a* and the second end of the second set of slots 54*b* is offset by 90 degrees to the second end of the first set of slots 54*a*. The first and second ends of the third set of slots 54*c* and the fourth set of slots 54*d* are related accordingly. The number and makeup of each set is not limited to this example, as each set may include any number of slots 54 (i.e., one or more). In addition, the number of sets is not limited to this example. The slot configuration displayed in FIG. 5 ensures that the bending flexibility is equal for bending in any of the possible bending directions along any angular orientation along the circumference of the coupler body. This is important to a rotating borehole string in a deviated borehole where the bending happens under rotation (rotating bending).

In an embodiment, one or more slots 54 include a stress relief feature, which is provided to relieve stress on regions of the coupler body 52 when the coupler 50 bends. Such stress relief facilitates bending and reduces the potential for damage to the body 52.

Figure 6A:
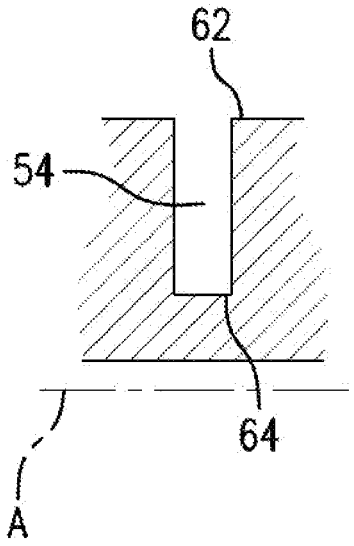
FIG. 6A depicts an embodiment of a slot having a generally rectangular profile for facilitating or aiding the damping of undesired oscillations.
Figure 6B:
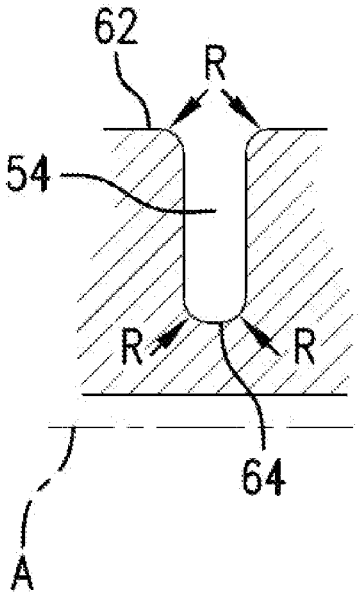
FIG. 6B depicts an embodiment of a slot having a stress relief feature that includes a rounded end of the slot.
Figure 6C:
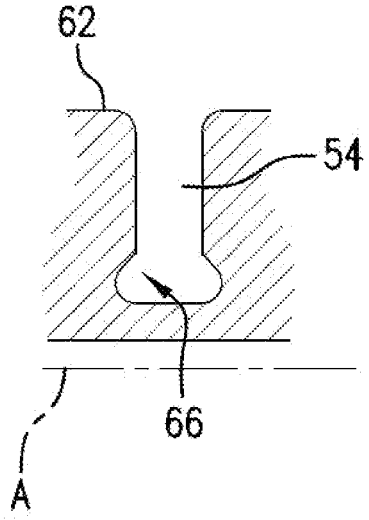
FIG. 6C depicts an embodiment of a slot having a stress relief cutout.

FIG. 6A shows an example of a slot 54 having a generally rectangular profile, which extends radially between inner edges 64 at an inner end of the slot 54 (bottom of the slot 54), and outer edges 62 at an outer surface of the body 52. FIGS. 6B and 6C depict examples of stress relief features. A generally rectangular slot 54 refers to a slot that defines an angle of about 90 degrees between the inner edge 64 and a side (axial) of the slot 54 (i.e., side extending from the inner edge 64 to the outer edge 62), or an angle that is within a selected range from 90 degrees (e.g., about 82 degrees to about 98 degrees). It is noted that the slot 54 is not limited to a rectangular or generally rectangular shape. For example, the slot 54 can define a V-shaped or tapered slot having selected flank angles (e.g., angles greater than about 8 degrees). The V-shaped slot may be symmetrical or asymmetrical.

In an embodiment, the stress relief feature is in the form of one or more rounded or curved edges at an outer end and/or at an inner end of the slot 54. For example, as shown in FIG. 6B, the inner edges 64 and the outer edges 62 are rounded to have a desired radius R. The radius R may be the same for the outer and inner edges or different. The stress relief feature is not limited to a radius or circular edge. For example, the stress relief feature can have any suitable profile, such as an arbitrary profile, a portion of an ellipse, or a combination of different radii or curvatures, such as a three-center curve.

Another example of a stress relief feature is shown in FIG. 6C. In this example, the inner end of the slot 54 includes stress relief cutouts 66. The cutouts 66 provide for an increase width of the slot 54 at the inner end, and may be circular or curved cutouts, or have any other desired profile.

Figure 7:
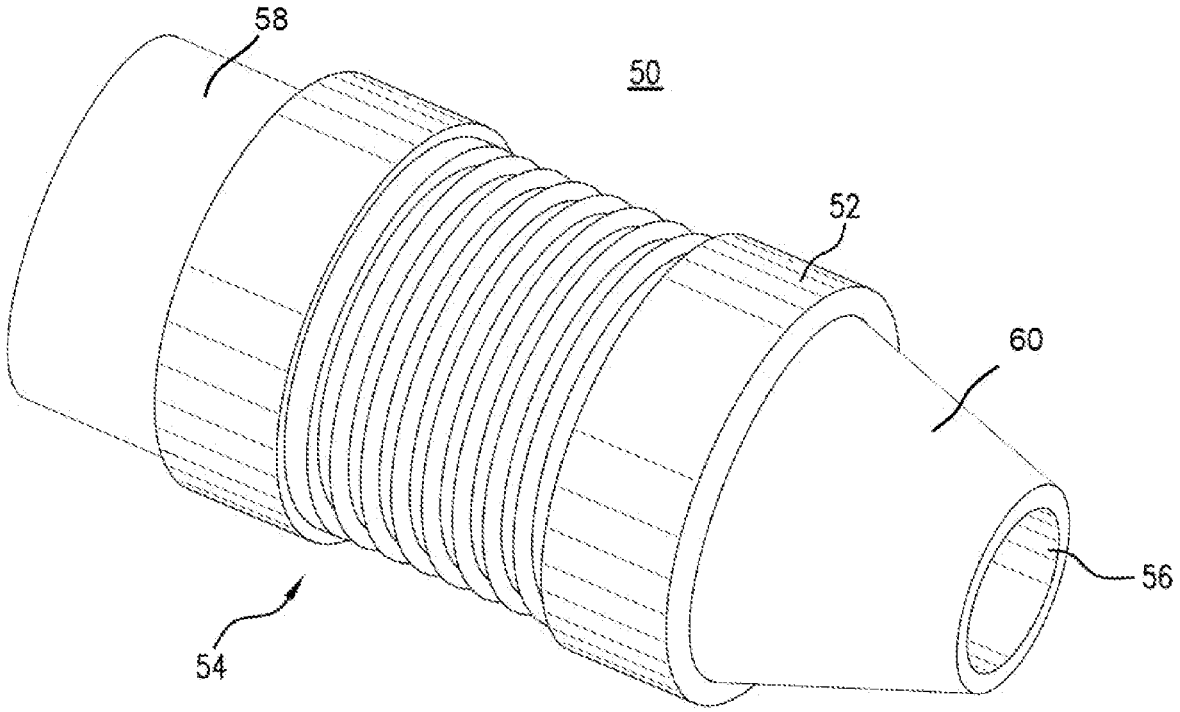
FIG. 7 depicts an embodiment of a coupler for facilitating or aiding the damping of undesired oscillations, including a plurality of slots forming a bellows configuration.

FIG. 7 depicts an embodiment of the coupler 50 having a plurality of slots 54 that extend fully along the periphery (360 degrees) of the coupler 50. Each slot 54 has a rounded outer end, such that the slots 54 form a bellows configuration.

Figure 8:
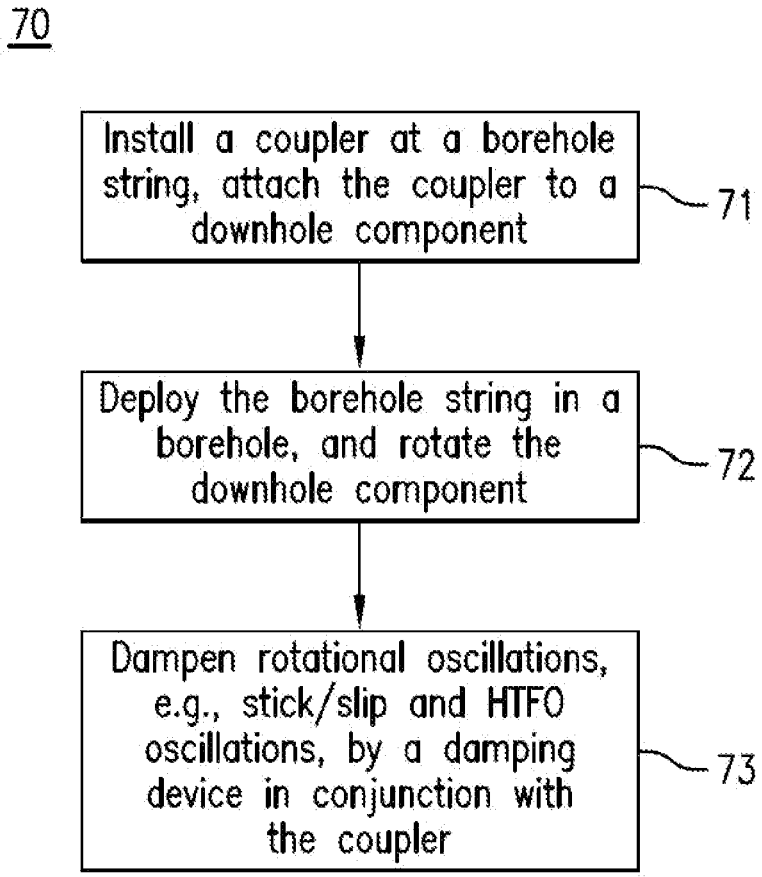
FIG. 8 is a flow diagram depicting an embodiment of a method of damping undesired oscillations during a subterranean operation.

FIG. 8 illustrates a method 70 of performing a subterranean operation and damping vibrations of a downhole component. The method 70 may be performed in conjunction with the system 10, but is not limited thereto. The method 70 includes steps or stages represented by blocks 71-73. In one embodiment, the method 70 includes the execution of all of the steps or stages in the order described. However, certain steps or stages may be omitted or added, or the order of the steps or stages may be changed.

At block 71, a coupler 50 is installed at a borehole string, such as the drill string 12. For example, the coupler 50 is connected at one end to a downhole component (e.g., the LWD tool 30) and connected at another end to another downhole component (e.g., the stabilizer 32). The borehole string may include a damping device (e.g., the damping device 34). A coupler may be installed at any number of locations (including more than one coupler) and connected to any desired components. For example, as shown in FIG. 1, a coupler 50 may be installed between the drill bit 22 and the LWD tool 30, and/or installed between the stabilizer 32 and the damping device 34. The coupler 50 may be located based on known or expected mode shapes, such as described in U.S. 20210079738 A1 and/or U.S. 20180252089 A1 (referenced above).

At block 72, the drill string 12 is disposed in a borehole, and the string (or portions thereof) is rotated as part of a drilling operation.

At block 73, during operation, each coupler 50 supports damping of undesired oscillations, such as HTFO modes. As discussed above, the dimensions of the slots are selected to aid damping selected modes or mode shapes, such as HFTOs above about 50 Hz. For example, the coupler shifts a maximum of the mode shape to be at or near the location of a damping device.

Set forth below are some embodiments of the foregoing disclosure:

Embodiment 1: A coupling device, comprising: an elongated coupler body configured to be deployed at a borehole string and connected to a downhole component of a borehole string, the coupler body having a longitudinal axis, the coupler body having a torsional stiffness sufficient to transmit rotational motion to the connected downhole component; and at least one recess formed in a wall of the coupler body, the at least one recess extending along a periphery of the coupler body in a direction generally perpendicular to the longitudinal axis, the at least one recess configured to impart a bending stiffness that is less than or equal to a reference bending stiffness, the torsional stiffness and the bending stiffness selected to modify a shape of an undesired torsional oscillation.

Embodiment 2: The coupling device of any prior embodiment, wherein the shape is modified to increase an effectiveness of a damping device in damping the undesired torsional oscillation.

Embodiment 3: The coupling device of any prior embodiment, wherein the coupler body includes a fluid conduit in fluid communication with the downhole component and configured to permit downhole fluid to flow through the coupler.

Embodiment 4: The coupling device of any prior embodiment, wherein the coupler body includes a conduit configured to hold a transmission element for relaying at least one of power and communication.

Embodiment 5: The coupling device of any prior embodiment, further comprising a flexible material disposed in the at least one recess.

Embodiment 6: The coupling device of any prior embodiment, wherein the at least one recess includes at least one slot having a length in the direction perpendicular to the longitudinal axis and a radial depth extending from an outer surface of the wall to an interior of the wall.

Embodiment 7: The coupling device of any prior embodiment, wherein the at least one slot is a plurality of slots, the plurality of slots including at least one first slot and at least one second slot, the at least one first slot being offset from the at least one second slot by a selected angle.

Embodiment 8: The coupling device of any prior embodiment, wherein, the borehole string including a damping device configured to damp the undesired torsional oscillation.

Embodiment 9: The coupling device of any prior embodiment, wherein the plurality of slots includes a first set of slots having a first angular position, a second set of slots having the first angular position, and a third set of slots having a second angular position that is offset from the first angular position by a selected angle.

Embodiment 10: The coupling device of any prior embodiment, wherein the selected angle is about 90 degrees.

Embodiment 11: The coupling device of any prior embodiment, wherein the at least one slot includes a stress relief feature configured to reduce being fatigue.

Embodiment 12: The coupling device of any prior embodiment, wherein the stress relief feature includes at least one of: curved outer edges at an outer surface of the body, and curved inner edges at an interior of the wall.

Embodiment 13: The coupling device of any prior embodiment, wherein the stress relief feature includes a cutout formed at an interior end of the at least one slot.

Embodiment 14: The coupling device of any prior embodiment, wherein the plurality of slots form a bellows configuration.

Embodiment 15: A method of performing a subterranean operation, the method comprising: deploying a borehole string in a borehole; performing the subterranean operation, the performing including rotating a downhole component; and modifying undesired oscillations occurring due to the rotating by a coupling device connected to the downhole component, the coupling device including an elongated coupler body having a longitudinal axis and a torsional stiffness sufficient to transmit rotational motion to the downhole component, the coupling device including at least one recess formed in a wall of the coupler body, the at least one recess extending along a periphery of the coupler body in a direction generally perpendicular to the longitudinal axis, the at least one recess imparting a bending stiffness that is less than or equal to a reference bending stiffness, the torsional stiffness and the bending stiffness selected to modify a mode shape of an undesired torsional oscillation.

Embodiment 16: The method of any prior embodiment, wherein the at least one recess includes at least one slot having a length in the direction perpendicular to the longitudinal axis and a radial depth extending from an outer surface of the wall to an interior of the wall.

Embodiment 17: The method of any prior embodiment, wherein the at least one slot includes a plurality of slots including at least one first slot and at least one second slot, the at least one first slot being offset from the at least one second slot by a selected angle.

Embodiment 18: The method of any prior embodiment, wherein the at least one slot includes a first set of slots having a first angular position, a second set of slots having the first angular position, and a third set of slots having a second angular position that is offset from the first angular position by a selected angle.

Embodiment 19: The method of any prior embodiment, wherein the at least one slot includes a stress relief feature configured to reduce being fatigue, wherein the stress relief feature includes at least one of: curved outer edges at an outer surface of the body, curved inner edges at an interior of the wall, and a cutout formed at an interior end of the at least one slot.

Embodiment 20: The method of any prior embodiment, wherein the borehole string includes a damping device, the method further comprising damping the undesired torsional oscillation using the damping device in conjunction with the coupling device.

In connection with the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A coupling device for mode shape modification of a torsional oscillation in a borehole string, comprising:

an elongated coupler body configured to be deployed at the borehole string and connected to a downhole component of the borehole string, wherein a damping device is disposed at a damping device location in the borehole string, the coupler body having a longitudinal axis and a circumference, the coupler body having a torsional stiffness sufficient to transmit rotational motion to the connected downhole component; and a plurality of recesses formed in a wall of the coupler body at different positions along a longitudinal axis of the coupler body, the plurality of recesses extending along a circumference of the coupler body in a direction forming an angle of greater than or equal to 80 degrees with the longitudinal axis, the plurality of recesses configured to impart a bending stiffness that is less than or equal to a reference bending stiffness, wherein the coupling device is disposed at a coupling device location in the borehole string, the torsional stiffness or the coupling device location selected to modify a mode shape of the torsional oscillation to maximize a torsional oscillation amplitude at the damping device location in the borehole string.

2. The coupling device of claim 1, wherein the plurality of recesses includes a plurality of slots, the plurality of slots defining a plurality of planes, wherein the plurality of planes form an angle between each other that is less than 5 degrees.

3. The coupling device of claim 1, wherein the coupling device location is selected based on a mathematical algorithm.

4. The coupling device of claim 1, wherein the coupler body includes an inner fluid bore extending along the longitudinal axis of the coupler body, the inner fluid bore in fluid communication with the downhole component and configured to permit downhole fluid to flow through the coupling device.

5. The coupling device of claim 1, wherein the coupler body is formed from an integral block of material and the coupler body includes a central support portion, the central support portion defining an inner fluid bore.

6. The coupling device of claim 1, further comprising a flexible material disposed in at least one recess of the plurality of recesses.

7. The coupling device of claim 1, wherein the plurality of recesses includes a plurality of slots, each slot of the plurality of slots having a length in a circumferential direction and a radial depth extending from an outer surface of the wall to an interior of the wall, wherein the plurality of slots define parallel planes.

8. The coupling device of claim 7, wherein the plurality of slots include a first slot and a second slot, the first slot and the second slot each having a first circumferential end, wherein the first circumferential end of the first slot is offset from the first circumferential end of the second slot by a selected angle along the circumference of the coupler body.

9. The coupling device of claim 7, wherein the plurality of slots includes a first set of slots having a first angular position along the circumference of the coupler body, a second set of slots having a second angular position along the circumference of the coupler body, and a third set of slots having a third angular position along the circumference of the coupler body, the second angular position offset from the first angular position, and the third angular position offset from the first angular position and the second angular position by at least one selected angle along the circumference of the coupler body.

10. The coupling device of claim 9, wherein the at least one selected angle is about 90 degrees.

11. The coupling device of claim 7, wherein at least one slot of the plurality of slots includes a stress relief feature configured to reduce bending fatigue, the stress relief feature including at least one of: curved outer edges at an outer surface of the coupler body, and curved inner edges at the interior of the wall of the coupler body.

12. The coupling device of claim 7, wherein the torsional stiffness is selected using a simulation algorithm.

13. The coupling device of claim 1, wherein the coupler body includes at least 20 slots.

14. The coupling device of claim 7, wherein the plurality of slots form a bellows configuration.

15. A method of performing mode shape modification of torsional oscillation in a borehole string in a subterranean operation, the method comprising:

deploying a borehole string in a borehole, the borehole string including a downhole component, a coupling device and a damping device, the coupling device disposed at a coupling device location in the borehole string, the damping device located at a damping device location in the borehole string, the coupling device including an elongated coupler body having a longitudinal axis and a circumference, the coupler body having a torsional stiffness sufficient to transmit rotational motion to the downhole component, the coupling device including a plurality of recesses formed in a wall of the coupler body at different positions along the longitudinal axis of the coupler body, the plurality of recesses extending along a circumference of the coupler body in a direction forming an angle of greater than or equal to 80 degrees with the longitudinal axis, the plurality of recesses imparting a bending stiffness that is less than or equal to a reference bending stiffness;

performing the subterranean operation, the performing including rotating the borehole string, the rotating including exciting a torsional oscillation;

selecting the torsional stiffness or the coupling device location to modify a mode shape of the torsional oscillation to maximize a torsional oscillation amplitude at the damping device location in the borehole string;

modifying the mode shape by the coupling device having the selected stiffness or the selected coupling device location in the borehole string; and damping the torsional oscillation with the damping device at the damping device location.

16. The method of claim 15, wherein the plurality of recesses includes a plurality of slots, each slot of the plurality of slots having a length in circumferential direction and a radial depth extending from an outer surface of the wall to an interior of the wall.

17. The method of claim 16, wherein the plurality of slots including a first slot and a second slot, the first slot being offset from the second slot by a selected angle along the circumference of the coupler body.

18. The method of claim 16, wherein the plurality of slots includes a first set of slots having a first angular position along the circumference of the coupler body, a second set of slots having a second angular position along the circumference of the coupler body, and a third set of slots having a third angular position along the circumference of the coupler body, the second angular position offset from the first angular position, and the third angular position offset from the first angular position and the second angular position by at least one selected angle along the circumference of the coupler body.

19. The method of claim 15, further comprising selecting the torsional stiffness using a simulation algorithm.

20. The method of claim 15, wherein the torsional oscillations are high frequency torsional oscillations greater than 50 Hz.

* * * * *